United States Patent [19]

Horn et al.

[11] 4,240,477

[45] Dec. 23, 1980

[54] MOVABLE SUPPORT ASSEMBLY FOR A BOARD INFEED SYSTEM

[75] Inventors: James N. Horn, Seattle; Lorne J. Garden, Mercer Island, both of Wash.

[73] Assignee: Saab-Scania Aktiebolag, Linkoping, Sweden

[21] Appl. No.: 43,445

[22] Filed: May 29, 1979

[51] Int. Cl.[3] ..... B27B 1/00; B27B 31/06

[52] U.S. Cl. ..... 144/245 R; 144/312

[58] Field of Search ..... 144/245 R, 245 A, 253 F, 144/312

[56] References Cited

U.S. PATENT DOCUMENTS

| | | | |
|---|---|---|---|
| 3,970,128 | 7/1976 | Kohlberg | 144/245 A |
| 3,983,403 | 9/1976 | Dahlström et al. | 144/312 X |
| 4,106,538 | 8/1978 | Sigfridsson et al. | 144/245 A X |

*Primary Examiner*—Willie G. Abercrombie
*Attorney, Agent, or Firm*—David L. Garrison

[57] ABSTRACT

A movable support assembly for supporting a chain-drive board infeed system. The chain-drive board infeed system feeds a board into a board edger or other similar woodworking apparatus. The movable support assembly includes a pair of frame rails for supporting the chain drive infeed system. Bearings are provided for moving the mounting frame in a lateral direction perpendicular to a predetermined infeed line of direction. This enables the mounting frame to be laterally positioned to position a board in a predetermined relationship with respect to a fixed position board edger. The frame rails are maintained in a generally parallel relationship with respect to the given infeed direction by a torque tube and linkage assembly. Both rollway and slide bearings are provided.

12 Claims, 11 Drawing Figures

MOVABLE SUPPORT ASSEMBLY FOR A BOARD INFEED SYSTEM

BACKGROUND OF THE INVENTION

1. Field of the Invention

This invention relates in general to apparatus for positioning boards to be fed through board edge cutters. In particular, the Invention relates to a movable support apparatus providing lateral positioning for a board infeed system. The particular boards handled by the board infeed system are called cants, that is, sawed portions of logs which have two substantially parallel surfaces formed at the top and bottom thereof and which have irregular edge surfaces exhibiting wane where wane is described as a defect in a plank or board which is characterized by a board having bark or insufficient wood at a corner or along the edge of a board due to the curvature of the log from which the board was sawed. Systems have been developed to optimize the yield from a particular cant in terms of maximizing the dollar value of the finished boards produced from the cant. Optimization is accomplished, for example, by a cant being optically scanned to determine the location of various edge and surface defects. The defects are removed in further processing of the board in accordance with and controlled by a predetermined computer program. Signals corresponding to the defects as well as predetermined economic and scheduling parameters are processed by a computer to optimize the yield from each cant. Various aspects of such optimization systems are disclosed in the Sanglert U.S. Pat. No. 3,886,372 assigned to the Saab-Scania Aktiebolag of Linkoping, Sweden and the Kohlberg U.S. Pat. No. 3,970,128 assigned to the Saab-Scania Aktiebolag of Linkoping, Sweden. The Sanglert patent discloses a pair of endless belts, one under each end portion of a cant. Each belt extends transversely to the length of the cant and each of the endless belts is driven by a reversible servo that is controlled by the outputs from a computer. Proper coordination of the movements of the two belts causes edgewise rotation and/or translation of the cant to present the cant to a pair of cutters. The cutters are illustrated as two saw blades, each of which is positioned in response to a computer output. The Kohlberg patent discloses a plurality of laterally spaced belt conveyors, all driven from a common drive shaft. The belts are driven so that a cant placed with its length transverse to the length of the belts is carried through a scanning station where the motion of the cant with respect to the belt is arrested while the cant is being scanned, with the arresting being performed by stops. The scanning operation includes establishment of a reference datum line for a particular board. After scanning, the cant moves on the belts toward a number of orienting stops which are positioned with respect to the reference datum line to obtain a particular angular orientation of the reference datum line established in the scanning operation. The particular angular orientation is determined in accordance with a computer program as previously described. The cant is then translated through the edging cutters while being maintained in the orientation established by the orienting stops. Each edge of a board is finished, or edged, by edging equipment. The edge cutters are adjustable and movable relative to one another. The prior art optimization systems for orienting cants with respect to movable edging cutters contemplate the use of variably positioned edging cutters and no provision is made in such systems for moving the infeed apparatus laterally in a direction perpendicular to the infeed line of direction. Fixed position edgers, such as edge saws, which are presently used in a larger number of manually controlled board optimization systems are not adaptable to be used with scanned optimizing systems of the type described above because current scanned optimization systems require lateral movement of both edgers. The edgers for manually controlled optimization systems have one fixed edging equipment, such as a saw, and one variably positioned edging device. The need thus exists for a means to adapt edging equipment having one fixed edging equipment to computer controlled optimizing scanner systems, which ordinarily contemplate moving both edging equipments.

SUMMARY OF THE INVENTION

It is, therefore, an object of this invention to provide apparatus for translating a board infeed system with respect to a fixed edger device to permit computer controlled board optimization systems to be used with existing board edging equipment.

It is another object of this invention to provide a movable infeed system which utilizes computer controlled output signals to control the position of the infeed support system.

It is a further object of this invention to provide a laterally movable support for a board infeed system which maintains the orientation of the board infeed system with respect to the infeed line of direction.

In accordance with these and other objects of the invention, a movable support assembly is provided mounted on a base for movably supporting a board infeed system which board infeed system feeds a board having a predetermined orientation with respect to a predetermined infeed line of direction along the predetermined infeed line of direction to woodworking apparatus. The support assembly is adapted to move the board infeed system in a lateral direction perpendicular to the predetermined infeed line of direction. The support assembly includes a movable mounting frame to which is mounted the board infeed system. Bearing means are provided which are positioned between the base and the movable mounting frame providing for lateral movement of the movable mounting frame with respect to the predetermined infeed line of direction. Means for laterally positioning the movable mounting frame with respect to the predetermined infeed line of direction are coupled between the movable mounting frame and the base. A means for maintaining a predetermined orientation of the movable mounting frame with respect of the predetermined infeed line of direction are coupled between the movable mounting frame and the base. According to one aspect of the invention the movable mounting frame includes a pair of frame rails extending longitudinally in a direction parallel to the predetermined infeed line of direction. According to another aspect of the invention the means for maintaining the predetermined orientation of the movable mounting frame with respect to the predetermined infeed line of direction is coupled to one of the pair of frame rails. According to another aspect of the invention the means for maintaining the predetermined orientation of the movable mounting frame includes a torsion member having a pair of arms with one end of each arm affixed to the torsion member member and the other end of each arm coupled to the one frame rail, such that orientation of the movable frame rail with respect to the direction parallel to the predetermined infeed line of direction is automatically maintained. According to another aspect of the invention the torsion member is a torque tube mounted on a pair of bearings fixed to the base. According to another aspect of the invention the means for laterally positioning the mounting frame is fluid operated.

BRIEF DESCRIPTION OF THE DRAWINGS

For a more complete understanding of the invention, reference is made to the drawings in which.

DESCRIPTION OF THE PREFERRED EMBODIMENTS

Figure 2:
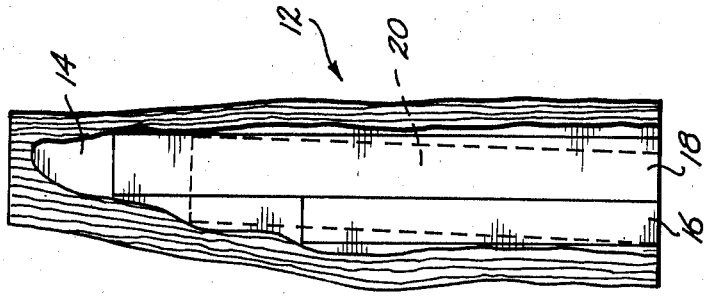
FIG. 2 is a plan view of a cant, or a board having opposite parallel surfaces, with projected cut lines as determined by a board optimization system.
Figure 1:
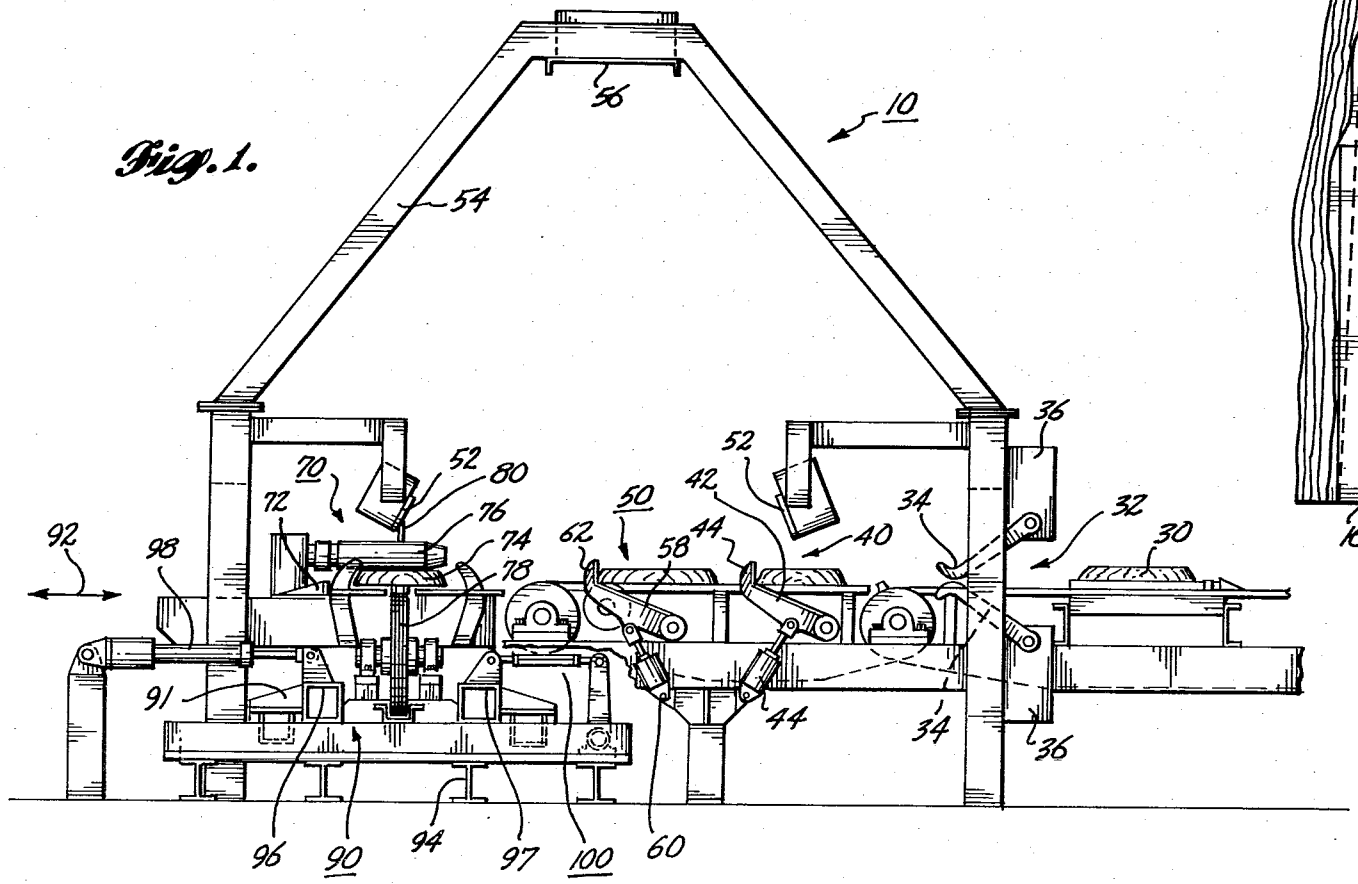
FIG. 1 is an elevational view showing a board optimization system including a laterally movable infeed system support assembly according to the invention.

Referring now to FIG. 1 of the drawing, a portion of an optimization system 10 is shown for obtaining the highest yield from a cant, that is a board having a parallel top and bottom surfaces but with irregular edge surfaces which exhibit a property called wane. Wane is defined as a defect in a plank or board caused by bark or insufficient wood at a corner or along an edge of the plank or board due to the curvature of the log from which the plank or board was originally sawed. As previously described in the prior art section, an edge optimization system is designed to produce maximum yield from a board 12 such as shown in FIG. 2 of the drawings. The cant shown exhibits a great deal of wane around the edges thereof. The solid lines shown on the flat surface 14 represents, for example, a first alternative for cutting the cant 12 to produce a pair of narrower boards 16, 18. The dotted lines shown on the flat surface 14 of the cant 12 in FIG. 2 represents another alternative cut to produce a wider board 20. The solid and dotted lines represent the results of an optimization calculation performed by a computer (not shown) to obtain from a given board output in accordance with various program variables. The particular finished boards obtained from a cant is obtained with woodworking apparatus controlled by the computer. Note that the dotted lines are not parallel to the solid lines and that the skewing of the board 12 may be required for further processing. The edge optimization system 10 partially shown in FIG. 1 of the drawing is representative of prior art edge optimization system and is not described in great detail in this specification.

FIG. 1 of the drawings shows various components of an edge optimization system 10. A board 30 is delivered to a thickness measuring station 32 where a pair of thickness measuring arms 34 engage the top and bottom surface of the board 30 for measurement thereof to provide thickness data to a computer (not shown) through the transducer boxes 36. A board is then moved to a holding station 40 where a pivotable arm 42 having a stopper end 44 is controlled by a hydraulic cylinder 46. A scanning station 50 is provided at which a board is illuminated at low angles of incidence to the board top surface by light sources 52 on opposite sides of the board. Mounted above the scanning station 50 on a frame 54 is a light scanning apparatus 56 which provides measurement data for use by the computer to calculate the best manner in which to further process a particular board in accordance with the computer optimization program. The measuring station includes a pivotable arm 58 which is actuated by a hydraulic cylinder 60 having a stopper end 62 for holding the board in position while being scanned by the scanning apparatus. Note that when the board is scanned, a datum line for an individual board is established in accordance with a calculation performed by the computer. A reference line for a particular board is established with respect to the datum line which determines the required amount of skew to be placed on a particular board before passing through an edger.

The final station of an edge optimization system for the actual cutting and edging of a cant is the infeed station 70 at which station a plurality of adjustable orienting stops (typically shown as 72) are positioned by servo systems under the control of the computer in accordance with the reference line established with respect to the datum line for a particular board. The stops 72 provide a properly skewed position for the board before it enters the cutters. A board 74 is shown in position with a pressure roller 76 located above the board and an infeed chain assembly 78 located below the board. A plurality of pressure rollers are lowered and the infeed chain assembly is raised to move the board into an edger device, including, for example, an edger saw 80 having a fixed lateral position and another variably positioned edger device (not shown).

This invention is concerned with a movable support assembly 90 which provides for lateral movement, that is movement along a line 92 perpendicular to the infeed direction of the infeed chain assembly 78 towards the fixed position edger saw 80. The movable support assembly 90 is affixed to and supported on a plurality of beams (typically shown at 94) which are in turn affixed to the floor of a mill and which form a base for the movable support assembly. The movable support assembly 90 has a movable mounting frame 91 for the infeed chain assembly 78 which includes a pair of frame rails 96, 97 to which the infeed chain assembly 78 is attached. A hydraulically operated positioning device 98 provides a means for laterally positioning the movable mounting frame 90. FIG. 1 further shows part of the frame alignment apparatus 100 for maintaining a predetermined alignment, or orientation, of the movable mounting frame 91 with respect to the predetermined infeed line of direction so that the frame rails 96 are in parallel alignment with the infeed direction.

Figure 3:
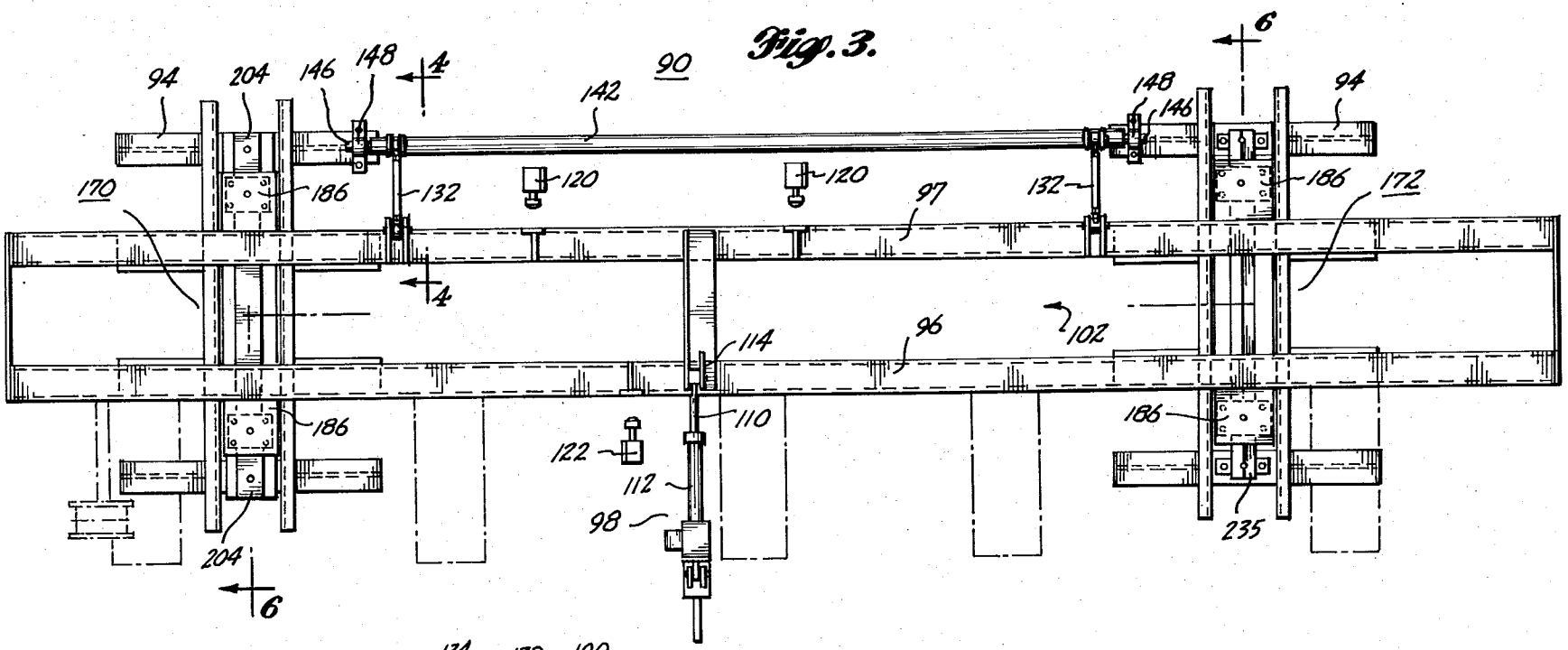
FIG. 3 is a plan view of a laterally movable infeed system support assembly according to the invention.

Referring now to FIG. 3 of the drawings, an infeed reference line 102 is shown which provides the reference line along which is positioned the saw edger 80 which has a fixed lateral position. The movable support assembly 90 is moved laterally with respect to the infeed reference line 102. The frame rails 96, 97 provide support for the infeed chain assembly 78 as shown in FIG. 1. The hydraulically operated positioning device 98 includes a control rod 110 activated by a hydraulic cylinder 112. The control rod 110 is pinned at the far end thereof to a setworks bracket 114 which is welded to one of the frame rails 96. The hydraulically operated positioning device 98 serves as means coupled between the movable mounting frame and the base for laterally positioning the movable mounting frame 91 with respect to the predetermined infeed line of direction. A pair of hydraulic shock dampers 120 are located on one side of the movable support assembly 90 and another shock damper 122 is located at the opposite side of the movable support assembly 90. The shock dampers 120, 122 are positioned at the extreme points traversed by the movable support assembly 90 on either side of the infeed reference line 102 to provide dampening while stopping further movement of the movable support assembly 90 in its extreme positions. As indicated in FIG. 3 the movable support assembly 90 moves so that a board is maintained in a position centered over the infeed chain assembly 78 which has a width of about 4 inches.

Figure 4:
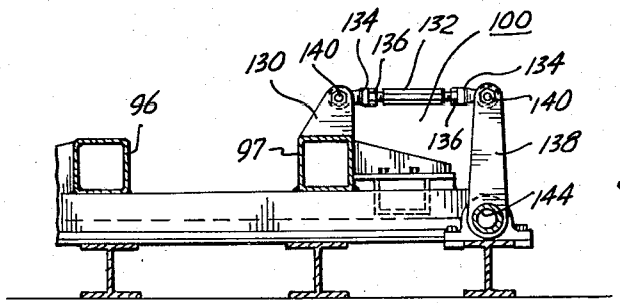
FIG. 4 is a partially sectional view taken along section line 4—4 of FIG. 3 of an embodiment of a means for maintaining the orientation of the movable mounting frame according to the invention.

FIG. 4 of the drawings shows further details of the frame alignment apparatus 100. Affixed to the frame rail 97 is a connecting arm bracket 130. A connecting rod 132 is threaded at both ends into correspondingly threaded bores in the ends of each of a pair of couplers 134. Each of the threaded ends of the connecting rod 132 is secured within the threaded bores of the couplers 134 by one of a pair of lock nuts 136. A coupling arm 138 as well as the connecting arm bracket 130 each respectively have an aperture formed therein for receiving a respective bolt 140 having a self-locking nut placed thereon which serve as pivot pins for the connecting members of the frame alignment apparatus 100. The coupling arms 138 each have an aperture 144 formed at the end thereof for receiving a torque tube 142 to which the coupling arms are fixed by welds. The torque tube 142 is, for example, formed from a 3 inch diameter steel pipe. Extending axially from the ends of the torque tube 142 and welded therein are respectively a pair of support axles 146 for the torque tube which have a diameter corresponding to the diameter of respectively a pair of pillow blocks 148 which contain bearings for rotatably supporting the torque tube assembly. The pillow blocks 148 are each mounted to one of the beams 94 forming the mounting base for the support assembly. The torque tube assembly described above serves as means coupled between the movable mounting frame and the base for maintaining a predetermined alignment of the movable mounting frame with respect to the predetermined infeed line of direction. With the alignment of the movable mounting frame maintained constant a board to be edged is always maintained in proper alignment with the board edging apparatus.

Figure 5:
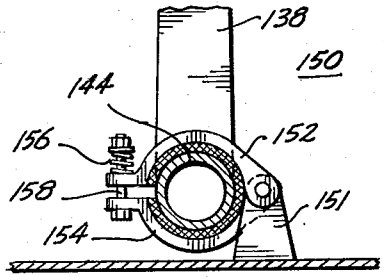
FIG. 5 is an enlarged side view of one type of brake for dampening the means for maintaining the orientation of the movable frame.

FIG. 5 shows a brake mechanism 150 for engaging an end of one of the support axles 146 which extends outwardly through the pillow blocks 148. The brake mechanism 150 is used where it is desirable to have some frictional dampening for lateral movement of the support assembly 90, for example, when very low-friction bearings are used as described hereinbelow. The brake mechanism 150 includes a base portion 151 affixed to the machine base to which are pivotally attached an upper clamp arm 152 and a lower clamp arm 154 having braking surfaces on the inner surfaces thereof, for engagement with the end of a support axle. The arms 152, 153 are urged together by a spring 156 located along a bolt 158 passing through apertures on the ends of each of the arms. The brake mechanism 150 provides frictional dampening of the torque tube assembly formed by the tube 142 and the arms 138.

FIG. 3 also shows a first bearing means 170 for supporting the frame rails 96 which is located closest to the edger saw 80 (shown in FIG. 1). A second bearing means 172 located away from the edger saw 80 is also shown in FIG. 3 of the drawings. The bearing means 170, 172 are positioned between the base 94 and the movable mounting frame 91 providing for lateral movement of the movable mounting frame 91 with respect to the predetermined infeed line of direction.

Figure 6:
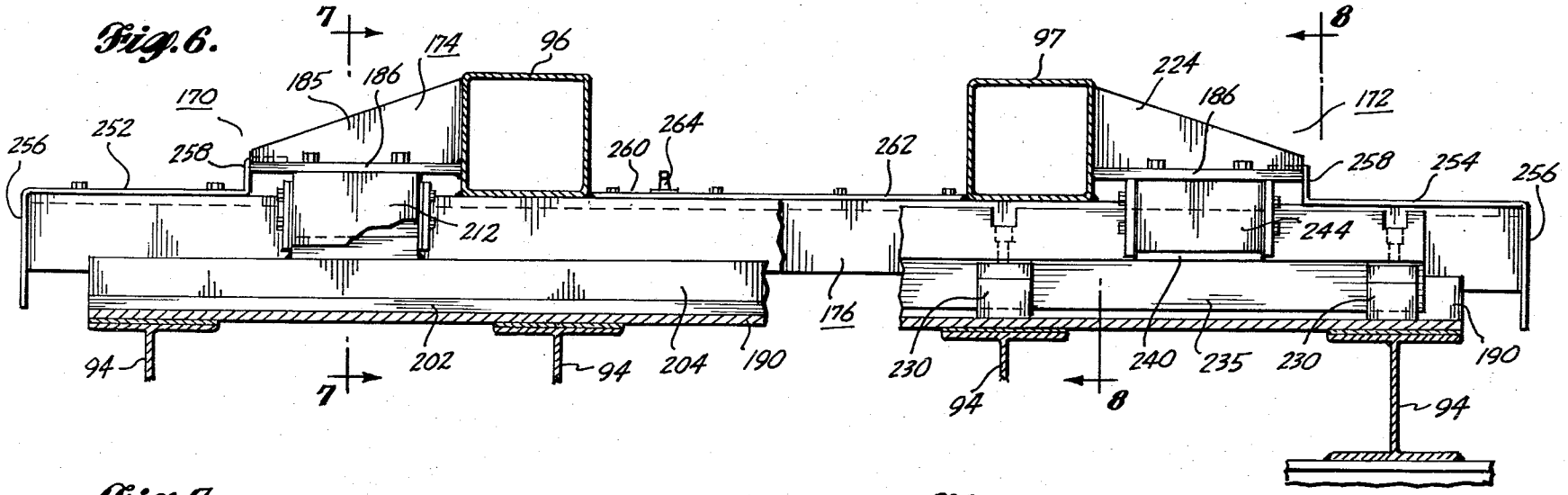
FIG. 6 is a partially sectional view taken along section line 6—6 of FIG. 3 and showing one embodiment of a laterally movable infeed system support assembly including slide bearing means in accordance with one aspect of the invention.
Figure 8:
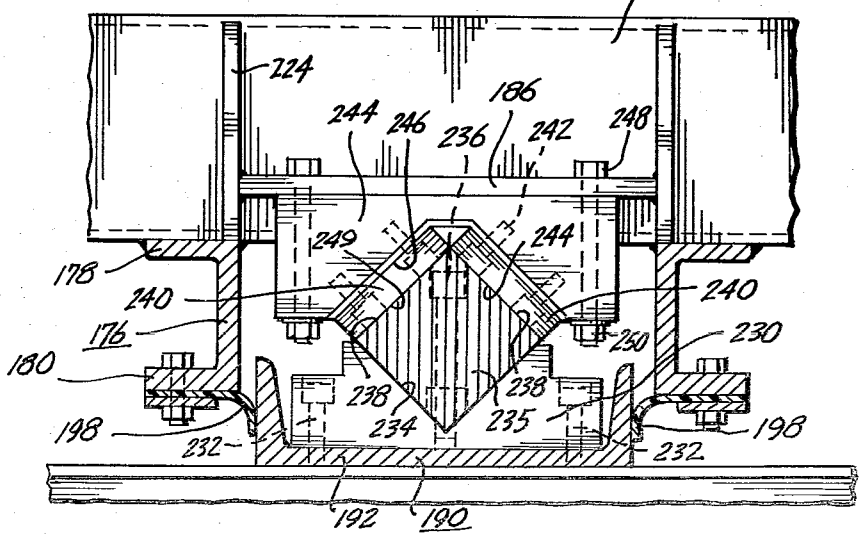
FIG. 8 is another sectional view of the bearing means of the embodiment of FIG. 6 of the drawings taken along sectional line 8—8.
Figure 7:
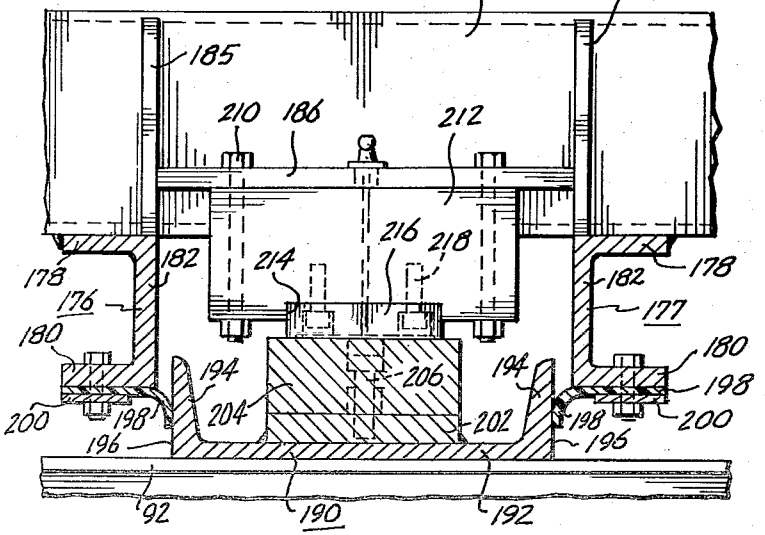
FIG. 7 is a sectional view of a portion of the laterally movable infeed system support assembly showing one embodiment of the bearing means taken along section line 7—7 of FIG. 6 of the drawings.

FIGS. 6, 7 and 8 show in greater detail one of the preferred embodiments of the movable support assembly 90 according to the invention.

Referring now to FIG. 6 of the drawings, part of the first bearing means 170 assembly is shown. The other part of the bearing means 170 is similar in construction and is not shown in detail. A bearing carrier frame 174 is formed as shown in FIGS. 7 and 8 of the drawings from a pair of channels 176, 177 each having an upper outwardly extending flange 178 and a lower outwardly extending flange 180 along with a base portion 182. Extending respectively upwardly from each of the base portions 182 of each channel is one of a pair of side plates 184, 185 each having a generally triangular shape as shown in FIG. 6 of the drawings. Extending inwardly from the inner surface of each of the side plates 184, 185 is a horizontal support plate 186. Plate 186 is welded to the side plates 184, 185 and the side plates 184, 185 are in turn welded to the channels 176, 177. The frame rail 96 is welded to the end of the triangular side plates 184, 185 and to the end of the horizontal plate 186 as shown in FIGS. 6 and 7 of the drawings. As shown in FIG. 7, affixed to the beams 94 forming the base of the entire support assembly is a support channel 190 having a central web portion 192 with a pair of upwardly extending flanges 194 formed at the ends of the central web 192. The outer surfaces 196 of the upwardly extending flanges 194 are generally planar in configuration. A pair of dirt shields 198 are formed from long strips of material having a curved shape which engages the planar outer surfaces 196 of each of the flanges 194. The dirt shields 198 are each fastened to the lower outwardly extending flanges 180 of the channels 176 by means of a keeper bar 200 which is fastened by a plurality of nut and bolt arrangements as shown in FIG. 7 of the drawings.

A raised mounting block 202 is welded to the web 192 of the support channel 190 as shown in FIG. 7 of the drawings. A demountable rectangular bearing block 204 is bolted to the mounting strip 202 by means of bolts (typically shown as 206) which extend through appropriate bores in the bearings block 204. The top surface 208 of the bearing block 204 serves as one surface of a slide bearing means. Attached to the horizontal plate 186 by a plurality of fasteners, such as nuts and bolts indicated typically as 210 in FIG. 7 is a top bearing support block 212 which has a channel 214 formed in the lower surface thereof for receiving a bearing pad 216 which is formed for example of bronze or nylatron and which is fastened to the top bearing support block 212 by means of bolts typically shown as 218 which are threaded into suitable apertures formed in the top bearing support block 212. The bottom surface 220 of the bearing pad 216 slidably engages the top surface 208 of the bearing block 204 forming a slide bearing assembly. The lower surface of the bearing pad 216 has formed therein a series of interconnecting lubricating fluid conduits which provide lubricating fluid through coaxial bores formed in the bearing pad 216, the top bearing support block, and the horizontal plate 186 for providing lubrication fluid from a suitable source of lubricating fluid (not shown) as well known in the art.

Referring now to FIG. 8 of the drawings, part of the second bearing means 172 is shown having a configuration somewhat different from the first bearing means previously described. The other part of the bearing means 172 is similar in construction and is not shown in detail. Frame rail 97 is welded to another bearing carrier frame 224 as described with respect to the other frame rail 96 and bearing carrier frame 174. FIG. 8 of the drawings shows some of the particulars of the second bearing means. Extending upwardly from the central web 192 of the support channel 190 is a lower bearing mounting block 230 which is attached to the support channel 190 by means of a plurality of bolts 232 which pass through bores in the lower bearing mounting block 230 and which engage threaded apertures in the support channel 190. The lower bearing mounting block 230 has a V-shaped channel 234 formed in the top portion thereof for receiving a demountable elongated lower bearing block 235 having a square cross section which is affixed to the bearing support block 230 by means of a plurality of bolts 236 extending through apertures in the bearing block 235 into threaded apertures in the lower bearing mounting block 230. The surfaces 238 of the bearing block 235 form the lower bearing surfaces for slidable engagement with a pair of bearing blocks 240 formed, for example, from bronze or nylatron which are affixed by a plurality of bolts (typically shown as 242) to an upper bearing mounting block 244 which has a generally triangular-shaped channel 246 formed therein. The upper bearing mounting block 244 is mounted to the horizontal plate 186 by means of bolts typically shown as 248 extending through apertures in the horizontal mounting plate 186 and the upper bearing mounting block 244 and engaging nuts (typically shown as 250). The lower surfaces 249 of the bearing blocks 240 slidably engage the upper surfaces 238 of the bearing blocks 234 forming a Vee slide bearing and permitting slidable lateral motion for the frame rails 96 supported thereupon. The surfaces of the bearing block 240 also contain a series of interconnected lubrication conducting channels connected to a pressurized lubrication system (not shown).

Referring now to FIG. 6 of the drawings, a pair of cover plates 252, 254 are fastened to the upper outwardly extending flanges 178 of the respective channels 176. Each of the cover plates 252, 254 has a downwardly extending flange 256 and an upwardly extending formed flange 258. Another pair of cover plates 260, 262 are fastened to the channels 176. One of the cover plates 260 has a fitting 264 for connection to a source of pressurized air, for example, the exhaust of an air cylinder. Suitable rubber booting (not shown) provides a closed interior for the structure surrounding the bearings. Pressurized air is provided to pressurize the interior of the apparatus surrounding the bearing assembly so as to prevent material, such as dirt and sawdust, from entering the bearing chamber.

The flat bearing pads 216 which slide along the bearing block 204 and the Vee slide bearings provided by the bearing blocks 240 which slide along the elongated lower bearing block 235, while having somewhat higher resistance due to friction, have some operational and maintenance advantages in the type of assembly provided according to the invention. The bearings and bearing blocks will tend to wear uniformly and can be periodically checked by operators and maintenance personnel for wear. Replacement of the bearings is simple and when the bearing blocks are worn, they can be turned over to expose a new, unworn bearing surface or surfaces.

Figure 9:
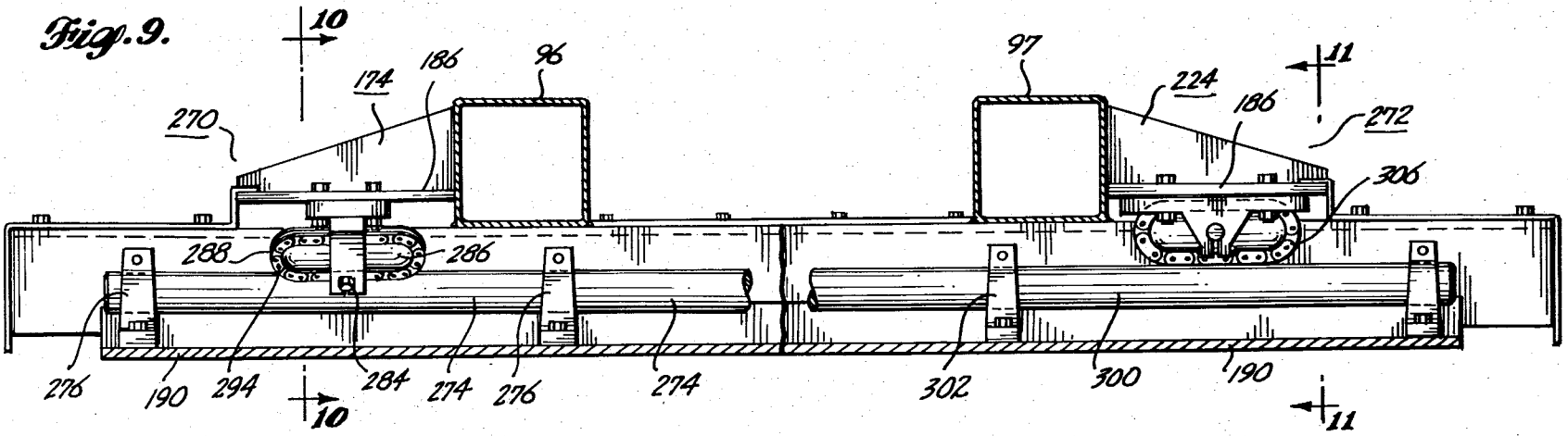
FIG. 9 is a partially sectional view taken along sectional line 6—6 of FIG. 3 and showing an alternative embodiment of the bearing means for movably supporting a transversely movable laterally movable infeed system support assembly according to the invention.

Referring now to FIG. 9 of the drawings, an alternative embodiment of bearing assemblies 270, 272 is shown wherein like reference numerals indicate components common to this alternative embodiment and the previously-described embodiment. The alternative embodiment basically uses roller chain bearings in place of the slide bearings of the first-described embodiment. The bearing carrier frames 174, 224 are formed as described with respect to the first embodiment and, respectively, have the frame rails 96, 97 welded thereto. Right angle members (typically shown as 273) are used instead of the channels 176, 177 used in the previous embodiment and the dirt shields contact the top of the base beam 94 as shown.

Figure 10:
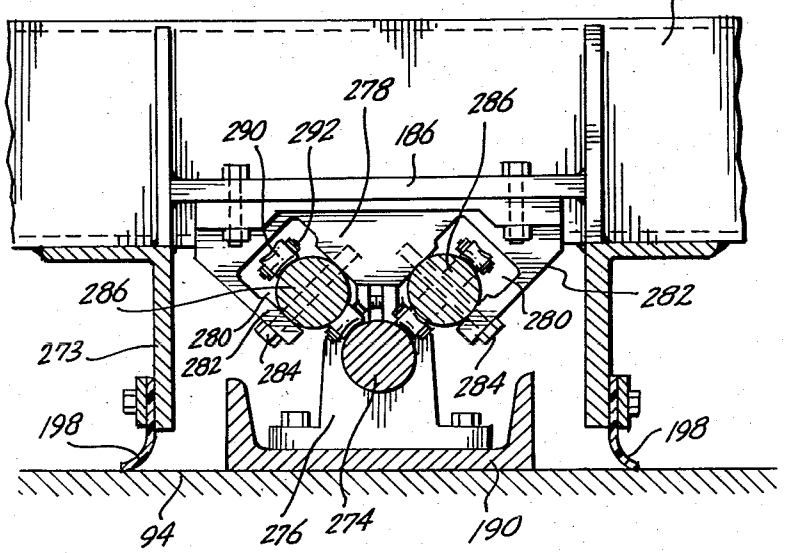
FIG. 10 is a sectional view of the alternative bearing means of FIG. 9 taken along sectional line 10—10.

One part of a first bearing means 270 of this embodiment is shown in the left half of FIG. 9 and in more detail in FIG. 10 of the drawings. One part of a second bearing means 272 is shown in the right half of FIG. 9 and in more detail in FIG. 11 of the drawings. The other parts of the bearing means 270, 272 are similar in construction and are not shown in detail.

As shown in FIGS. 9 and 10 a way shaft 274 formed, for example, from a 2 inch steel rod which extends along the length of the support channel 190 and is affixed thereto by means of four way support blocks 276. Attached to and extending below the horizontal plate 186 is a bearing support bracket 278. The bearing support bracket 278 has two openings 280 formed at forty-five degrees with respect to the horizontal plate 186 and at ninety degrees with respect to each other. Extending through the respective outside walls 282 of the bearing support bracket 278 are a pair of bolts 284, the ends of which are threadably engaged in bores formed in the inside walls of the openings 280. Each of the bolts 284 serves as a support pin for one of a pair of cylinders 286 having rounded ends which each serve as roller ways for one of a pair of roller chains 288. The roller chains 288 are formed with a plurality of concave rollers (typically shown as 290) which rotate about one of a plurality of pins (typically shown as 292). The pins 292 are spaced apart by a series of links (typically shown as 294). In operation, the roller chain moves around the outside length of the roller way cylinders 286 which the rollers 290 in rolling contact with the way shaft, thus providing a low friction bearing means for the movable support assembly 10. Because of the low friction properties of this type of roller chain bearing, a dampening means such as brake mechanism 150 is employed to provide resistive dampening to the assembly.

Figure 11:
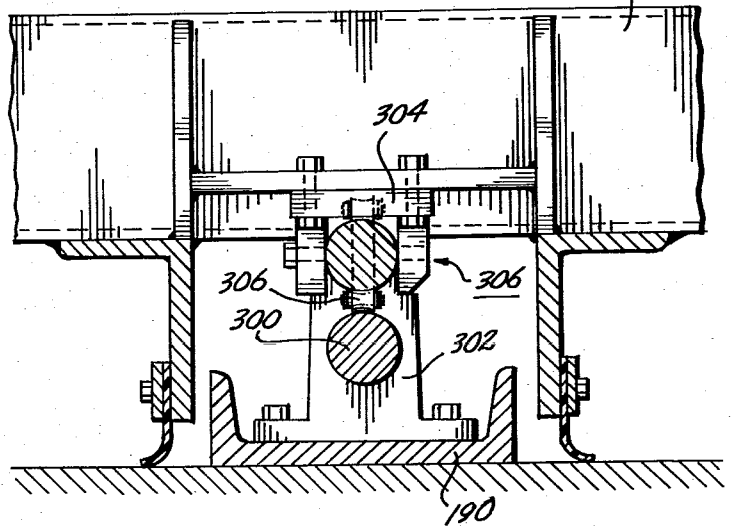
FIG. 11 is another sectional view of the alternative bearing means of FIG. 9 of the drawings taken along sectional line 11—11.

Referring now to FIG. 11, the second bearing means 272 is shown in more detail and includes a second way shaft 300 which is fixed to the support channel 190 by four other way support blocks (typically shown as 302). A bearing support bracket 304 supports a roller chain assembly 306 which is similar to one of the previously-described roller chain assemblies with the exception that just one roller chain is used.

The construction of the respective bearing means 170, 172 and 270, 272 provides that one 170, 272 of the bearing means essentially operates in a horizontal plane and provides that the other 172, 270 operates in a Vee configuration providing respective assemblies which moves essentially only in a direction perpendicular to the infeed line of direction which maintains the alignment, or orientation, of the movable mounting frame 91 with respect to the infeed line of direction. Misalignment is further prevented by the frame alignment apparatus 100 which includes the torque tube 100 to which are rigidly fixed the two coupling arms 138. Any misalignment of the mounting frame 91 with respect to the base of the assembly 90 would cause the torque tube to be twisted. Twisting of the torque tube causes oppositing, realignment forces to be exerted against the frame rail 96. Thus, the Vee arrangement of the bearing assemblies which keeps the mounting frame 91 in alignment is assisted by the frame alignment apparatus 100.

Referring to FIG. 3 of the drawings, in operation the mounting frame 90 of the laterally movable support assembly 10 according to the invention is positioned using the hydraulic cylinder 112 which positions the mounting frame 91 in response to control signals provided by the optimization computer (not shown). This permits a computer-controlled board optimization system to be used with a fixed position edging device, such as edging saws, which are used in existing board processing installations.

While particular embodiments of the present invention have been shown and described, it should be understood that the invention is not limited thereto since many modifications may be made. It is therefore contemplated to cover by the present application any and all such modifications which fall within the true spirit and scope of the basic underlying principles disclosed and claimed herein.

I claim:

1. A movable support assembly mounted on a base for movably supporting a board infeed system, which board infeed system feeds a board having a predetermined orientation with respect to a predetermined infeed line of direction along said predetermined infeed line of direction to woodworking apparatus, the support assembly adapted to laterally move the board infeed system along a line perpendicular to the predetermined infeed line of direction, the support assembly comprising:

a movable mounting frame to which is mounted the board infeed system;

bearing means positioned between the base and the movable mounting frame providing for lateral movement of the movable mounting frame with respect to the predetermined infeed line of direction;

means coupled between the movable mounting frame and the base for laterally positioning the movable mounting frame with respect to the predetermined infeed line of direction; and means coupled between the movable mounting frame and the base for maintaining a predetermined alignment of the movable mounting frame with respect to the predetermined infeed line of direction.

2. The assembly of claim 1 wherein the movable mounting frame includes a pair of frame rails extending longitudinally in a direction parallel to the predetermined infeed line of direction.

3. The assembly of claim 2 wherein the means for maintaining the predetermined alignment of the movable mounting frame with respect to the predetermined infeed line of direction is coupled to one of the pair of frame rails.

4. The assembly of claim 3 wherein the means for maintaining the predetermined alignment of the movable mounting frame includes a torsion member having a pair of arms with one end of each affixed to the torsion member and the other end of each coupled to the one frame rail such that orientation of the movable frame rails with respect to the direction parallel to the predetermined infeed line of direction is automatically maintained.

5. The assembly of claim 4 including a pair of bearings mounted to the base and wherein the torsion member is a torque tube mounted in said bearings.

6. The assembly of claim 5 including a pair of coupling rods each coupled intermediate to one of the arms and to the one frame rail.

7. The assembly of claim 4 further including a brake coupled to the torsion member to provide dampening therefor.

8. The assembly of claim 1 wherein the means for laterally positioning the mounting frame is fluid operated.

9. The assembly of claim 1 wherein the bearing means includes a first bearing means which includes a first slide bearing assembly and a second Vee slide bearing assembly each mounted for horizontal movement of the movable mounting frame with respect to the predetermined infeed line of direction such that the movable mounting frame maintains its orientation with respect to the predetermined infeed the of direction.

10. The assembly of claim 9 wherein the first slide bearing assembly includes a demountable bar having a bearing surface formed thereon and includes a demountable bearing pad having another bearing surface formed thereon for sliding engagement with the bearing surface of the demountable bar.

11. The assembly of claim 9 wherein the second Vee slide bearing assembly includes a demountable bar having two bearing surfaces formed thereon with the bearing surfaces positioned at an angle with respect to each other and includes a plurality of demountable bearing blocks each having a bearing surface for sliding engagement with one of the two bearing surfaces formed on the demountable bar such that both of the bearing surfaces of the demountable bar are engaged by at least one demountable bearing block so that the movable mounting frame is constrained by the second Vee slide bearing assembly to maintain its orientation with respect to the predetermined infeed line of direction.

12. The assembly of claim 1 wherein the bearing means includes a first roller chain bearing and a first way shaft along which the first roller chain bearing rides and wherein the bearing means includes a second and a third roller chain bearing and a second way shaft along which the second and the third roller chains ride with the second and the third roller chains positioned at an angle with respect to each other such that the movable mounting frame maintains its alignment with respect to the predetermined infeed line of direction.

* * * * *